US010611612B2

(12) United States Patent
Jin et al.

(10) Patent No.: US 10,611,612 B2
(45) Date of Patent: Apr. 7, 2020

(54) LIFTER

(71) Applicant: Haiyan Aihua Machinery Co., LTD, Jiaxing (CN)

(72) Inventors: Aiyu Jin, Jiaxing (CN); Yanbin Jin, Jiaxing (CN)

( * ) Notice: Subject to any disclaimer, the term of this patent is extended or adjusted under 35 U.S.C. 154(b) by 224 days.

(21) Appl. No.: 15/865,244

(22) Filed: Jan. 8, 2018

(65) Prior Publication Data

US 2019/0100418 A1 Apr. 4, 2019

(30) Foreign Application Priority Data

Sep. 29, 2017 (CN) ..... 2017 1 0903325
Sep. 29, 2017 (CN) ..... 2017 1 0903500

(51) Int. Cl.

| | |
|---|---|
| ***B66F 5/02*** | (2006.01) |
| ***B66F 3/02*** | (2006.01) |
| ***B66F 3/00*** | (2006.01) |
| ***B66F 7/02*** | (2006.01) |
| ***B66F 7/22*** | (2006.01) |

(52) U.S. Cl.

CPC ..... *B66F 5/02* (2013.01); *B66F 3/00* (2013.01); *B66F 3/02* (2013.01); *B66F 7/02* (2013.01); *B66F 7/22* (2013.01); *B66F 2700/03* (2013.01)

(58) Field of Classification Search

CPC ..... B66F 19/00; B66F 7/02; B66F 7/0625; B66F 7/26; B66F 7/28; B66F 5/00; B66F 2700/00; B66F 5/09; B66F 9/07; B25H 1/00; B25H 1/0021; B25H 1/0035; B25H 1/0042

See application file for complete search history.

(56) References Cited

U.S. PATENT DOCUMENTS 1,393,165 A * 10/1921 Rhedmon ..... B25H 1/00 269/78
2,976,033 A * 3/1961 Martin ..... B25H 1/0007 269/17
5,100,283 A * 3/1992 Carty ..... B66C 23/48 187/240
5,135,205 A * 8/1992 Bedard ..... B25H 1/0007 254/100
5,141,211 A * 8/1992 Adams, Jr. ..... B25H 3/06 269/16

(Continued)

*Primary Examiner* — Tyrone V Hall, Jr.

(74) *Attorney, Agent, or Firm* — Bayramoglu Law Offices LLC

(57) ABSTRACT

A lifter includes a support base, a first elevating stand assembly, a first elevating-drive mechanism, a turning-drive mechanism and a bracket mechanism. A lower portion of the first elevating stand assembly is provided with two sets of first fixing racks. The support base is symmetrically mounted on the first fixing racks. One side of the first elevating stand assembly is provided with a first elevating-drive mechanism. A first elevating stand is installed inside the first elevating stand assembly. The first elevating-drive mechanism drives the first elevating stand to move through the transmission mechanism. The turning-drive mechanism is provided with a support base. One end of the support base is hinged to a movable support frame. The other end of the support base is provided with a locking assembly. The turning-drive mechanism is provided with a bracket mechanism.

9 Claims, 7 Drawing Sheets

(56) References Cited

U.S. PATENT DOCUMENTS

| | | | | |
|---|---|---|---|---|
| 5,707,450 | A * | 1/1998 | Thompson | B05B 13/0285 118/500 |
| 5,863,034 | A * | 1/1999 | Vauter | B23K 37/04 269/17 |
| 5,915,742 | A * | 6/1999 | Hung | B25B 11/02 269/17 |
| 6,837,934 | B1 * | 1/2005 | Patrykus | B05B 13/0285 118/500 |
| 7,448,606 | B1 * | 11/2008 | Johnson | B05B 13/0285 269/16 |
| 8,328,173 | B1 * | 12/2012 | DesForge | B25H 1/0007 248/176.1 |
| 9,016,664 | B1 * | 4/2015 | Powers | B05C 13/02 254/2 B |
| 2012/0181494 | A1 * | 7/2012 | Guyard | B66F 3/00 254/385 |

* cited by examiner

LIFTER

CROSS REFERENCE TO RELATED APPLICATIONS

This application is based upon and claims priority to Chinese Patent Application No. 201710903500X, filed on Sep. 29, 2017, and Chinese Patent Application No. CN2017109033254, filed on Sep. 29, 2017, the entire contents of which are incorporated herein by reference.

TECHNICAL FIELD

The present invention relates to the field of object transportation, and more particularly to a lifter.

BACKGROUND

In areas such as home furnishing, etc., the objects usually need to be lifted to complete the work. Currently, the objects are manually lifted, which not only requires high intensity labor, but also is dangerous. Moreover, the object can fall down easily, thereby causing serious damages to the object, or even worse, the object may be destroyed. Further, the working efficiency of such method is low. The height of the existing lifter is adjustable, whereas the size of the carrier bracket is not adjustable, so the application scope is limited and less universal. In order to solve the above-mentioned problems and improve the service performance of the object lifter, a lifter is proposed to replace the manual lifting. Additionally, since the object that needs to be lifted often occupies a large space, the bracket portion and the support portion of the corresponding lifter are normally fixed perpendicular to each other, the lifter in an idle state often occupies a large space, and for lifting the lifter to high elevation, the worker would need the help of an auxiliary ascent device to be able to fix and mount the lifted object, causing the inconvenient operations. Therefore, this lifter is proposed.

SUMMARY OF THE INVENTION

The objective of the present invention is to solve the problems in the prior art and provide a lifter which aims to solve the technical problems of requirement of high intensity labor for manually lifting of the objects, requirement of an ascent device during the operation, k working efficiency and the large space occupied by lifter in an idle state, in the prior art.

In order to realize the above-mentioned objective, the present invention provides a lifter which includes a support base, a first elevating stand assembly, a first elevating-drive mechanism, a turning-drive mechanism and a bracket mechanism. A lower portion of the first elevating stand assembly is provided with two sets of first fixing racks. The support base is symmetrically mounted on the first fixing racks. One side of the first elevating stand assembly is provided with a first elevating-drive mechanism. A first elevating stand is mounted inside the first elevating stand assembly. The first elevating-drive mechanism drives the first elevating stand to move through a transmission mechanism. The first elevating stand is provided with a second elevating stand. The turning-drive mechanism is provided with a support base. The support base is mounted on the top of the second elevating stand. One end of the support base is hinged to a movable support frame, and the other end of the support base is provided with a locking assembly. The turning-drive mechanism is provided with a bracket mechanism.

Preferably, the first elevating stand assembly is provided with a first fixing mounting frame. One side of the first mounting frame is provided with an auxiliary mounting frame. A lower portion of the auxiliary mounting frame is provided with two sets of first fixing racks. The support base includes a first load-bearing frame and a second load-bearing frame, and the first load-bearing frame and the second load-bearing frame are symmetrically arranged. The first load-bearing frame and the second load-bearing frame are hinged to the first fixing rack. A support board is arranged on the first load-bearing frame and the second load-healing frame. A lower portion of the auxiliary mounting frame is further provided with a positioning mounting rack. The positioning mounting rack corresponds to the auxiliary mounting frame located below the positioning mounting rack. A positioning connecting rod is hinged on the positioning mounting frame. The first load-bearing frame is provided with a positioning pin. The positioning connecting rod and the positioning pin cooperate with each other. The first elevating stand is mounted inside the first fixing mounting frame. A first wheel assembly is mounted on the side wall of the first elevating stand. A second wheel assembly is mounted on the side wall of the first fixing mounting frame. The transmission mechanism cooperates with the second wheel assembly and the first wheel assembly through a first traction rope.

Preferably, the first load-bearing frame includes a first support frame, a first support crossbar, a second support crossbar, a reinforced vertical rod, a hinge joint and a roller. The roller is mounted on a bottom portion of the first support flame. A side wall of the first support frame is provided with the first support crossbar and the second support crossbar. An end of both the first support crossbar and the second support crossbar is provided with the hinge joint. The hinge joint is connected to the first fixing rack. The first fixing rack includes two symmetrically arranged fixing plates. The hinge joint is mounted between the fixing plates. Each of the fixing plate is provided with a connecting plate and a mounting flange. The connecting plate is perpendicular to the mounting flange. The connecting plate is fixed on a side wall of the auxiliary mounting frame. The mounting flange is L-shaped, and the mounting flange cooperates with the hinge joint.

Preferably, the first elevating-drive mechanism further includes a support armrest, a first mounting frame, a driving handle and a first traction rope. The support armrest is mounted on the first elevating stand assembly. The support armrest is internally provided with a first mounting frame. A transmission mechanism is mounted on the first mounting frame. The transmission mechanism is connected to the driving handle. The transmission mechanism cooperates with the first elevating stand assembly via the first traction rope.

The present invention provides a lifter which includes a support base, a second elevating stand assembly, a hand-driven elevating mechanism, a turning-drive mechanism and a bracket mechanism. A lower portion of the second elevating stand assembly is provided with the support base. The hand-driven elevating mechanism is arranged on one side of the second elevating stand assembly. The hand-driven elevating mechanism is internally provided with a drive gear. A third elevating stand is mounted inside the second elevating stand assembly. A side wall of the third elevating stand is provided with a rack. The rack cooperates with the drive gear. The hand-driven elevating mechanism drives the third elevating stand to move through driving the gear. The third elevating stand is provided with a fourth elevating stand. A side wall of the third elevating stand is provided with a drive roller. The drive roller cooperates with the fourth elevating stand through a second traction rope. One end of the second traction rope is fixed on a positioning block. The other end of the second traction rope is fixed on a bottom portion of the fourth elevating stand. The turning-drive mechanism is provided with a support base. The support base is mounted on the top of the second elevating stand. One end of the support base is hinged to a movable support frame, and the other end of the support base is provided with a locking assembly. The turning-drive mechanism is provided with a bracket mechanism.

Preferably, the elevating stand assembly is further provided with a second fixing mounting frame and a second armrest. The second armrest is mounted on one side of the second fixing mounting frame. The second fixing mounting frame is internally provided with a third elevating stand. One side of the second fixing mounting frame is provided with a positioning block. The other side of the second fixing mounting frame is provided with a lock assembly. The lock assembly cooperates with the rack. A position-limiting locking ring is arranged below the lock assembly.

Preferably, the turning-drive mechanism further includes a bracket fixing flame, a handle and a position-limiting post. A locking flange is arranged at an end of the movable support frame. A first positioning hole is set within the locking flange. The locking assembly cooperates with the first positioning hole. A trigger rod is arranged below the locking assembly. An expansion and a contraction of the locking assembly in a horizontal direction is controlled by the trigger rod. A handle is fixed on a side wall of the movable support frame. An end of the handle is provided with an anti-slide sleeve. A bracket fixing flame is arranged above the movable support frame. The bracket mechanism is mounted on the bracket fixing frame.

Preferably, the bracket mechanism includes a first fixing bracket frame, a second fixing bracket frame, a T-shaped bracket frame and an adjustable connection flame. The first fixing bracket frame and the second fixing bracket frame are arranged in parallel. The adjustable connection frame is mounted at an end of the first fixing bracket frame and an opposite end of the second fixing bracket frame, respectively. A T-shaped bracket frame is inserted into the end of the adjustable connection frame. The adjustable connection frame is provided with two fastening bolts. The fastening bolts cooperate with the first fixing bracket frame, the second fixing bracket frame and the T-shaped bracket frame. Both sides of the adjustable connection frame are provided with a longitudinally telescopic bracket. An auxiliary fastening bolt is arranged below the longitudinal telescopic bracket. An end of the longitudinal telescopic bracket is provided with a holding locking assembly. The holding locking assembly includes a mounting case and a block.

The advantages of the present invention are as follows. The present invention has an appropriate structure, with the use of a foldable and retractable support base and a bracket mechanism which can be turned over. The present invention can be folded and stored when not in use, so that it is easy to store and organize and occupies less storage space. With the use of lifting tube group, the position adjustment of the bracket assembly of the lifter is realized through a hand-drive transmission, so that the present invention can satisfy different work requirements of the height and achieve the lifting of the work material, and thereby greatly reducing the labor and labor intensity. With the bracket mechanism being movably installed on the turning-drive mechanism, when the material is loaded the incline angle of the bracket can be selected according to the actual demands. With the locking assembly being arranged at the end of the bracket, the inclined work material is supported, so the present invention has strong adaptability With a detachable support board being arranged on the support base, the operator can stand on the support board to complete the work at a high position, so the present invention is practical.

The features and advantages of the present invention will be described in detail in the embodiments with reference to the drawings hereinafter.

DETAILED DESCRIPTION OF THE INVENTION

Embodiment 1

Figure 1:
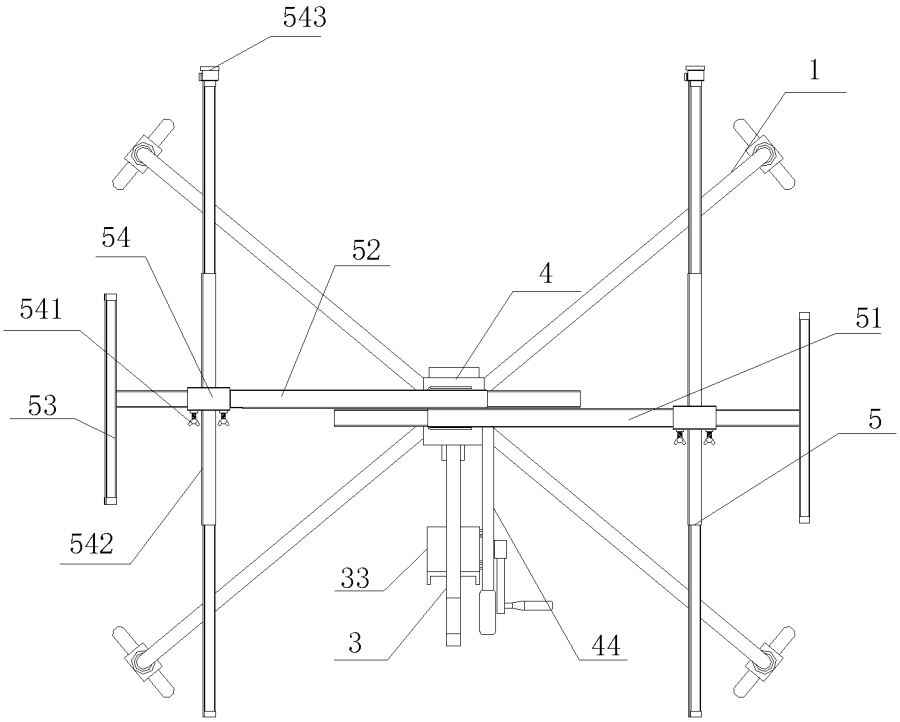
FIG. 1 is a structural schematic diagram of the top view of a lifter according to the first embodiment of the present invention.
Figure 2:
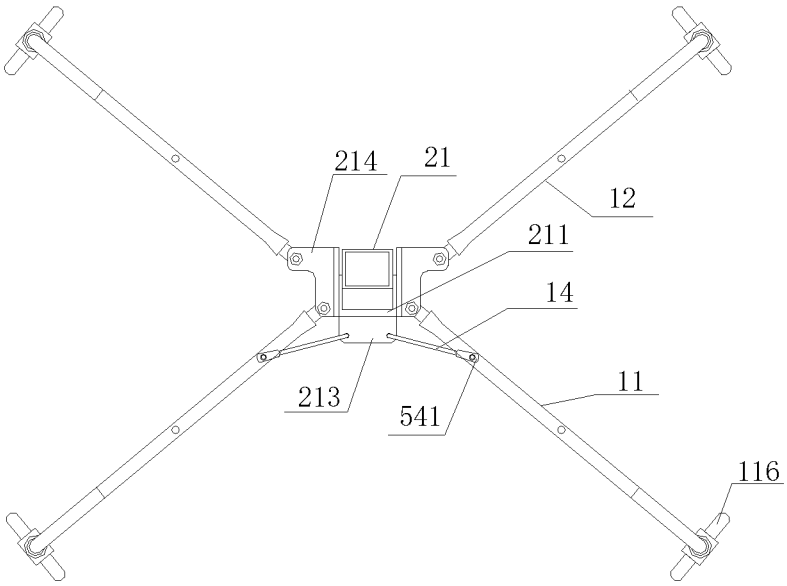
FIG. 2 is a schematic diagram of the top view of a support: base of the lifter according to the first embodiment of the present invention.
Figure 3:
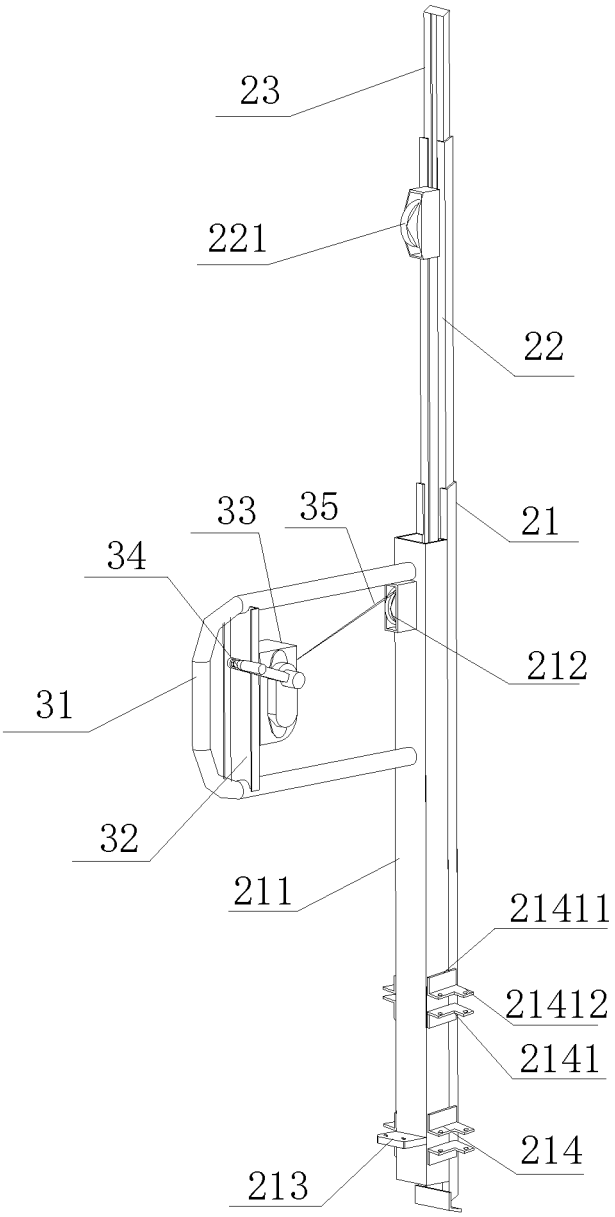
FIG. 3 is a structural schematic view of a first elevating stand assembly of the lifter according to the first embodiment of the present invention.
Figure 4:
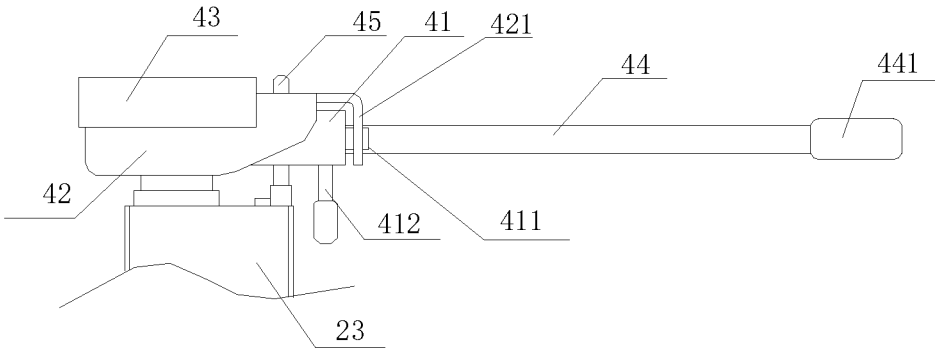
FIG. 4 is a schematic diagram of the left view of a turning-drive mechanism of the lifter of the present invention.
Figure 5:
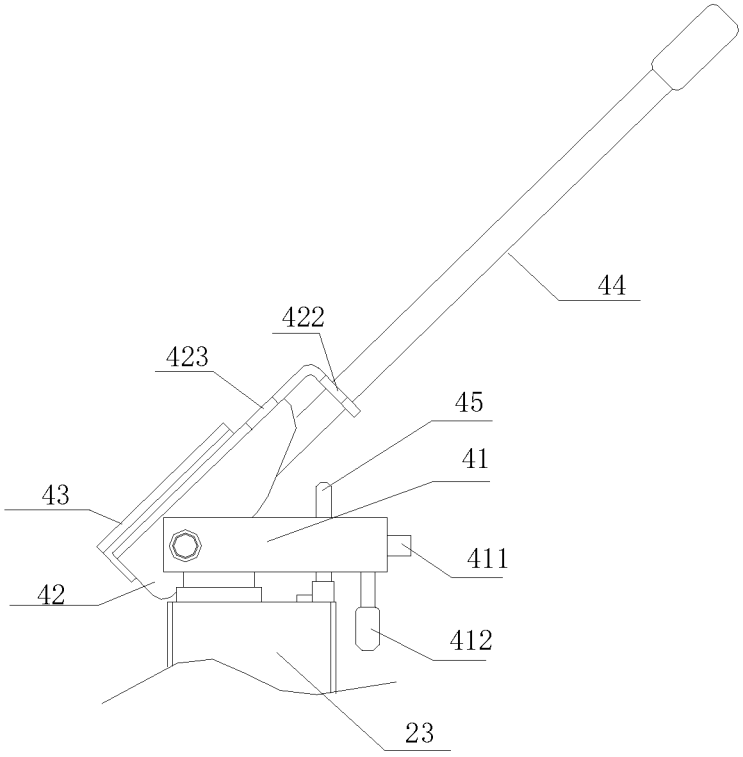
FIG. 5 is a schematic view of the turning-drive mechanism of the lifter in a working state of the present invention.
Figure 6:
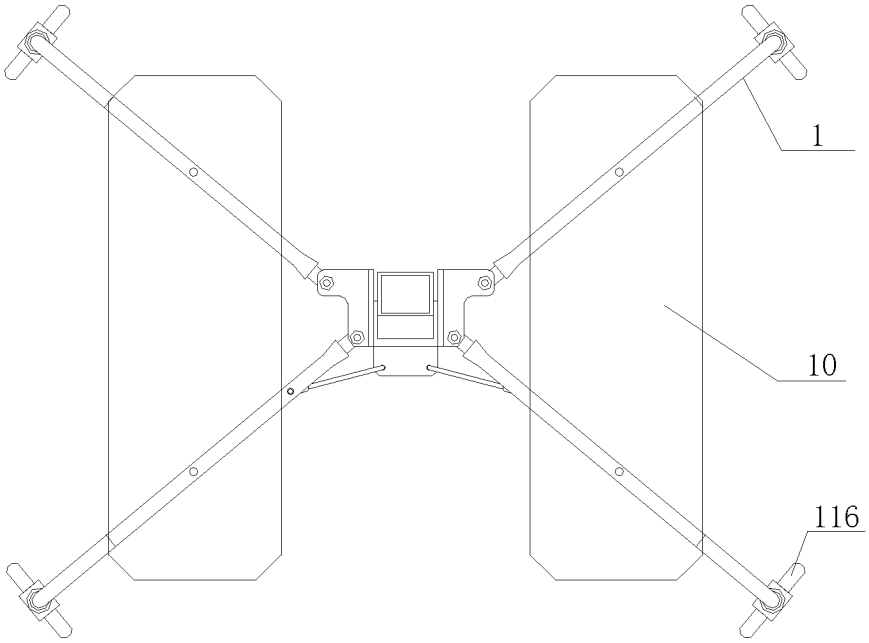
FIG. 6 is a schematic diagram of a support base of the lifter in a working state according to the first embodiment of the present invention.
Figure 7:
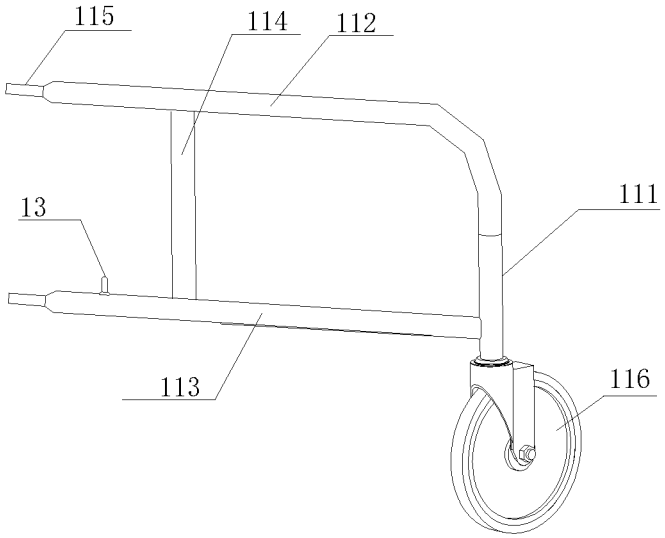
FIG. 7 is a structural schematic diagram of a first load-bearing frame of the lifter according to the first embodiment of the present invention.
Figure 8:
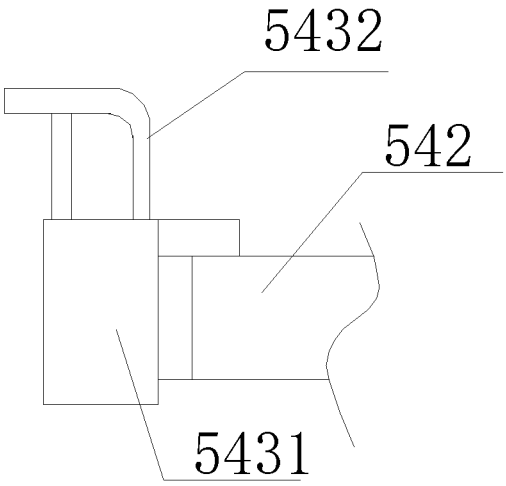
FIG. 8 is a schematic diagram of the left view of a holding locking assembly of the lifter of the present invention.

Referring to FIG. 1-FIG. 8, the lifter of the present invention includes a support base 1, a first elevating stand assembly 2, a first elevating-drive mechanism 3, a turning-drive mechanism 4 and a bracket mechanism 5. A lower pan of the first elevating stand assembly 2 is provided with two sets of first fixing, racks 214. The support base 1 is symmetrically mounted on the first fixing racks 214. One side of the first elevating stand assembly 2 is provided with a first elevating-drive mechanism 3. A first elevating stand 22 is mounted inside the first elevating stand assembly 2. The first elevating-drive mechanism 3 drives the first elevating stand 22 to move through a transmission mechanism 33. The first elevating stand 22 is provided with a second elevating stand 23. The turning-drive mechanism 4 is provided with a support base 41. The support base 41 is mounted on the top of the second elevating stand 23. One end of the support base 41 is hinged to a movable support frame 42, and the other end of the support base 41 is provided with a locking assembly 411. The turning-drive mechanism 4 is provided with a bracket mechanism 5. The first elevating stand assembly 2 is provided with a first fixing mounting frame 21. One side of the first fixing mounting frame 21 is provided with an auxiliary mounting frame 211. A lower portion of the auxiliary mounting frame 211 is provided with two sets of first fixing racks 214. The support base 1 includes a first load-bearing frame 11 and a second load-bearing frame 12, and the first load-bearing frame 11 and the second load-bearing frame 12 are symmetrically arranged. The first load-beating frame 11 and the second load-bearing frame 12 are hinged to the first fixing rack 214. A support board 10 is arranged on the first load-bearing frame 11 and the second load-bearing frame 12. A lower portion of the auxiliary mounting frame 211 is further provided with a positioning mounting rack 213. The positioning mounting rack 213 corresponds to the auxiliary mounting frame 211 located below the positioning mounting rack 213. A positioning connecting rod 14 is hinged on the positioning, mounting frame 213. The first load-bearing frame 11 is provided with a positioning pin 13. The positioning, connecting rod 14 and the positioning pin 13 cooperate with each other. The first elevating stand 22 is mounted inside the first fixing mounting frame 21. A first wheel assembly 221 is mounted on the side wall of the first elevating stand 22. A second wheel assembly 212 is mounted on the side wall of the first fixing mounting frame 21. The transmission mechanism 33 cooperates with the second wheel assembly 212 and the first wheel assembly 221 through a first traction rope 35. The first load-bearing frame 11 includes a first support frame 111, a first support crossbar 112, a second support crossbar, a reinforced vertical rod 114, a hinge joint 115 and a roller 116. The roller 116 is mounted on a bottom portion of the first support frame 111. A side wall of the first support frame 111 is provided with the first support crossbar 112 and the second support crossbar 113. An end of both the first support crossbar 112 and the second support crossbar 113 is provided with the hinge joint 115. The hinge joint 115 is connected to the first fixing rack 214. The first fixing rack 214 includes two symmetrically arranged fixing plates 2141. The hinge joint 115 is mounted between the fixing plates 2141. Each of the fixing plates 2141 is provided with a connecting plate 21411 and a mounting flange 21412. The connecting plate 21411 is perpendicular to the mounting flange 21412. The connecting plate 21411 is fixed on a side wall of the auxiliary mounting frame 211. The mounting flange 21412 is L-shaped, and the mounting flange 21412 cooperates with the hinge joint 115. The first elevating-drive mechanism 3 further includes a support armrest 31, a first mounting frame 32, a driving handle 34 and a first traction rope 35. The support armrest 31 is mounted on the first elevating stand assembly 2. The support armrest 31 is internally provided with a first mounting frame 32. A transmission mechanism 33 is mounted on the first mounting frame 32. The transmission mechanism 33 is connected to the driving handle 34. The transmission mechanism 33 cooperates with the first elevating stand assembly 2 via the first traction rope 35.

Embodiment 2

Figure 9:
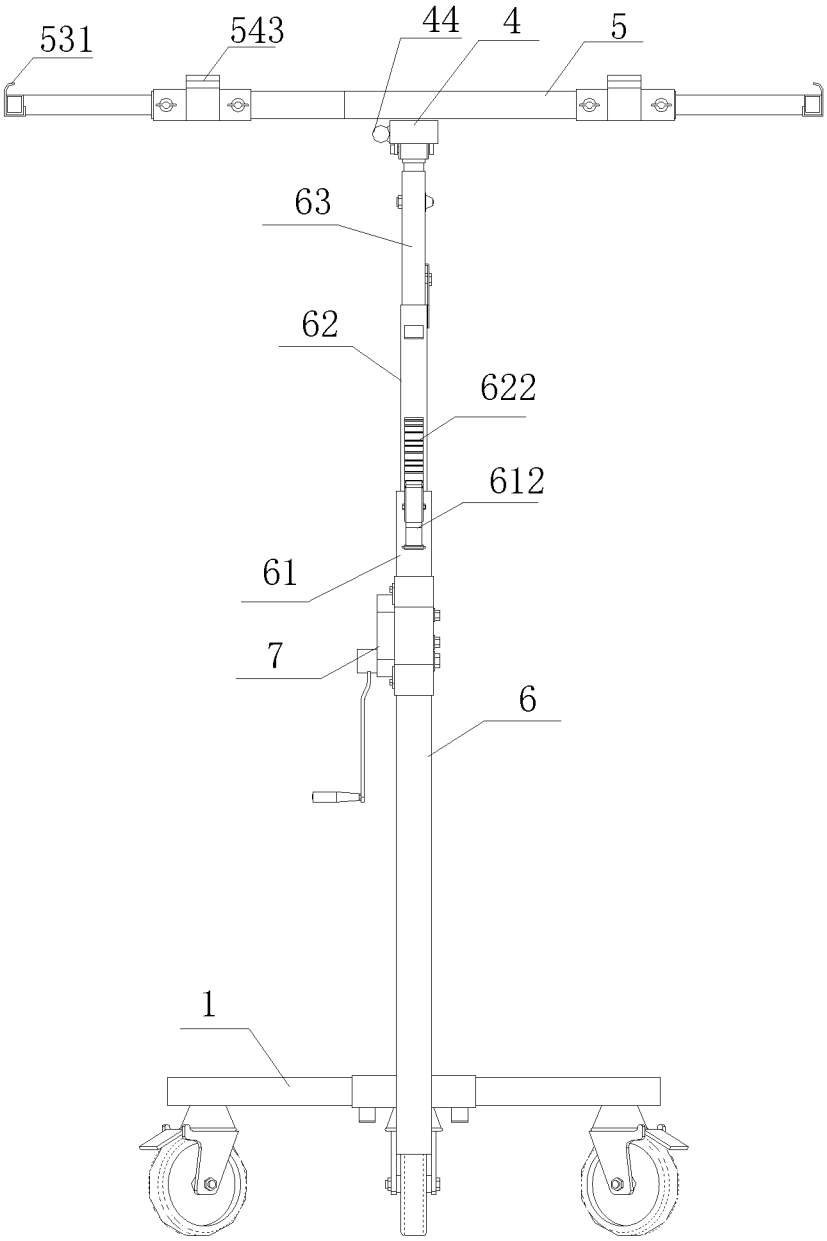
FIG. 9 is a structural schematic diagram of the lifter according to the second embodiment of the present invention.
Figure 10:
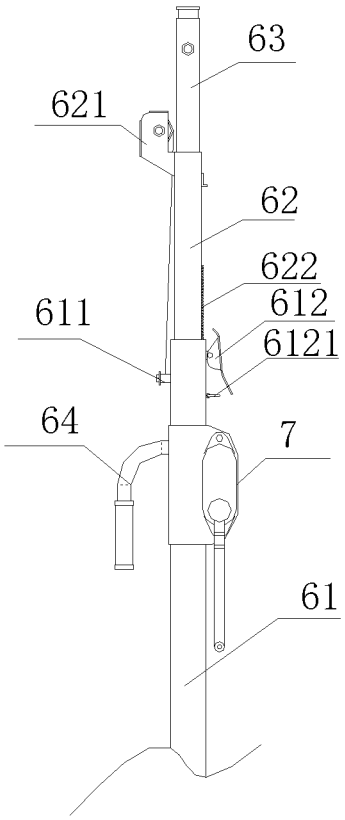
FIG. 10 is a structural schematic diagram of a second elevating stand assembly of the lifter according to the second embodiment of the present invention.

Referring to FIGS. 4, 5, 8, 9, and 10, the lifter of the present invention includes: a support base 1, a second elevating stand assembly 6, a hand-driven elevating mechanism 7, a turning-drive mechanism 4 and a bracket mechanism 5. A lower portion of the second elevating stand assembly 6 is provided with the support base 1. The hand-driven elevating mechanism 7 is arranged on one side of the second elevating stand assembly 6. The hand-driven elevating mechanism 7 is internally provided with a drive gear. A third elevating stand 62 is mounted inside the second elevating stand assembly 6. A side wall of the third elevating stand 62 is provided with a rack 622. The rack 672 cooperates with the drive gear. The hand-driven elevating mechanism 7 drives the third elevating stand 62 to move through driving the gear. The third elevating stand 62 is provided with a fourth elevating stand 63. A side wall of the third elevating stand 62 is provided with a drive roller 621. The drive roller 621 cooperates with the fourth elevating stand 63 through a second traction rope. One end of the second traction rope is fixed on a positioning block 611. The other end of the second traction rope is fixed on a bottom portion of the fourth elevating stand 63. The turning-drive mechanism 4 is provided with a support base 41. The support base 41 is mounted on the top of the second elevating stand 23. One end of the support base 41 is hinged to a movable support frame 42, and the other end of the support base 41 is provided with a locking assembly 411. The turning-drive mechanism 4 is provided with a bracket mechanism 5. Thee elevating stand assembly 6 is further provided with a second fixing mounting frame 61 and a second armrest 64. The second armrest 64 is mounted on one side of the second fixing mounting frame 61. The second fixing mounting frame 61 is internally provided with a third elevating stand 62. One side of the second fixing mounting frame 61 is provided with a positioning block 611. The other side of the second fixing mounting frame 61 is provided with a lock assembly 612. The lock assembly 612 cooperates with the rack 622. A position-limiting locking ring 6121 is arranged below the lock assembly 612.

The turning-drive mechanism 4 further includes a bracket fixing frame 43, a handle 44 and a position-limiting post 45. A locking flange 421 is arranged at the end of the movable support frame 42. A first positioning hole 422 is set within the locking flange 421. The locking assembly 411 cooperates with the first positioning hole 422. A trigger rod 412 is arranged below the locking assembly 411. An expansion and a contraction of the locking assembly 411 in a horizontal direction is controlled by the trigger rod 412. A handle 44 is fixed on a side wall of the movable support frame 42. An end of the handle 44 is provided with an anti-slide sleeve 441. A bracket fixing frame 43 is arranged above the movable support frame 42. The bracket mechanism 5 is mounted on the bracket fixing frame 43.

The bracket mechanism 5 includes a first fixing bracket frame 51, a second fixing bracket frame 52, a T-shaped bracket frame 53 and an adjustable connection frame 54. The first fixing bracket frame 51 and the second fixing bracket frame 52 are arranged in parallel. The adjustable connection frame 54 is mounted at an end of the first fixing bracket frame 51 and an opposite end of the second fixing bracket frame 52, respectively. A T-shaped bracket frame 53 is inserted into the end of the adjustable connection frame 54. The adjustable connection frame 54 is provided with two fastening bolts 541. The fastening bolts 541 cooperate with the first fixing bracket frame 51, the second fixing bracket frame 52 and the T-shaped bracket frame 53. Both sides of the adjustable connection frame 54 are provided with a longitudinal telescopic bracket 542. An auxiliary fastening bolt is arranged below the longitudinal telescopic bracket 542. An end of the longitudinal telescopic bracket 542 is provided with a holding locking assembly 543. The holding locking assembly 543 includes a mounting case 5431 and a block 5432.

The working process of the present invention is as below. The working principle of a lifter of the present invention is as follows. With the use of lifting tube group, the position adjustment of the bracket assembly of the lifter is realized through a hand-drive transmission, so that the present invention can satisfy different work requirements of the height and achieve the lifting of the work material, and thereby greatly reducing the labor and labor intensity. With the bracket mechanism being movably installed on the turning-drive mechanism, when the material is loaded, the incline angle of the bracket can be selected according to the actual demands, so as to lift the work material to a desired height. Subsequently, the turning-drive mechanism can be unlocked. The process is as follows. First, the trigger rod 412 is pushed to drive the locking assembly 411 to move horizontally to detach from the first positioning hole 422. After that, the handle 44 is turned by hand to make the bracket mechanism 5 inclined. Meanwhile, the locking assembly 543 is arranged at the end of the bracket to aid to support the work material in the inclined state, so the present invention has strong adaptability. With a detachable support board arranged on the support base and the support base connected to the support board through bolts, the operator can stand on the support board to complete the work at a high position, so the present invention is practical. When the lifter needs to be retracted for storage, the support board can be removed. When the bracket mechanism 5 needs to retract for storage, the turning-drive mechanism 4 should be unlocked first, then the bracket mechanism 5 should be turned to the same side of the elevating stand assembly to complete the retraction. With the use of the foldable and retractable support base and the bracket mechanism which can be turned over, the present invention can be folded and stored when not in use, so that it is easy to store and organize and can reduce the storage space.

The embodiments described above are only intended to illustrate the present invention rather than limit the invention. Any solution that is derived from the present invention with simple variations should be included within the scope of the present invention.

What is claimed is:

1. A lifter, comprising:

a first support base, a first elevating stand assembly, a first elevating-drive mechanism, a turning-drive mechanism, and a bracket mechanism;

wherein, a lower portion of the first elevating stand assembly is provided with two sets of first fixing racks;

the first support base is symmetrically mounted on the first fixing racks;

one side of the first elevating stand assembly is provided with the first elevating-drive mechanism;

a first elevating stand is mounted inside the first elevating stand assembly;

the first elevating-drive mechanism is configured to drive the first elevating stand to move through a transmission mechanism;

the first elevating stand is provided with a second elevating stand;

the turning-drive mechanism is provided with a second support base;

the second support base is mounted on the top of the second elevating stand;

one end of the second support base is hinged to a movable support frame, and another end of the second support base is provided with a locking assembly; and the turning-drive mechanism is provided with the bracket mechanism, the turning-drive mechanism further comprises a bracket fixing frame, a handle, and a position-limiting post;

a locking flange is arranged at an end of the movable support frame;

a first positioning hole is provided within the locking flange;

the locking assembly cooperates with the first positioning hole;

a trigger rod is arranged below the locking assembly;

the trigger rod controls the locking assembly to expand and contract in a horizontal direction;

a handle is fixed on a side wall of the movable support frame;

an end of the handle is provided with an anti-slide sleeve;

the bracket fixing frame is arranged above the movable support frame; and the bracket mechanism is mounted on the bracket fixing frame.

2. The lifter of claim 1, wherein, the first elevating stand assembly is provided with a first fixing mounting frame;

one side of the first fixing mounting frame is provided with an auxiliary mounting frame;

a lower portion of the auxiliary mounting frame is provided with two sets of first fixing racks;

the first support base includes a first load-bearing frame and a second load-bearing frame, and the first load-bearing frame and the second load-bearing frame are symmetrically arranged;

the first load-bearing frame and the second load-bearing frame are hinged to the first fixing rack;

a support board is arranged on the first load-bearing frame and the second load-bearing frame;

a lower portion of the auxiliary mounting frame is further provided with a positioning mounting rack;

the positioning mounting rack corresponds to the auxiliary mounting frame located below the positioning mounting rack;

a positioning connecting rod is hinged on the positioning mounting frame;

the first load-bearing frame is provided with a positioning pin;

the positioning connecting rod and the positioning pin cooperate with each other;

the first elevating stand is mounted inside the first fixing mounting frame;

a first wheel assembly is mounted on a side wall of the first elevating stand;

a second wheel assembly is mounted on a side wall of the first fixing mounting frame;

the transmission mechanism cooperates with the second wheel assembly and the first wheel assembly through a first traction rope.

3. The lifter of claim 2, wherein, the first load-bearing frame comprises a first support frame, a first support crossbar, a second support crossbar, a reinforced vertical rod, a hinge joint, and a roller;

the roller is mounted on a bottom portion of the first support frame;

a side wall of the first support frame is provided with the first support crossbar and the second support crossbar;

an end of each of the first support crossbar and the second support crossbar is provided with the hinge joint;

the hinge joint is connected to the first fixing rack;

the first fixing rack includes two symmetrically arranged fixing plates;

the hinge joint is mounted between the fixing plates;

each of the fixing plates is provided with a connecting plate and a mounting flange;

the connecting plate is perpendicular to the mounting flange;

the connecting plate is fixed on a side wall of the auxiliary mounting frame;

the mounting flange is L-shaped; and the mounting flange cooperates with the hinge joint.

4. The lifter of claim 1, wherein, the first elevating-drive mechanism further comprises a support armrest, a first mounting frame, a driving handle and a first traction rope;

the support armrest is mounted on the first elevating stand assembly;

the support armrest is internally provided with the first mounting frame;

the transmission mechanism is mounted on the first mounting frame;

the transmission mechanism is connected to the driving handle;

the transmission mechanism cooperates with the first elevating stand assembly via the first traction rope.

5. The lifter of claim 1, wherein, the bracket mechanism comprises a first fixing bracket frame, a second fixing bracket frame, a T-shaped bracket frame, and an adjustable connection frame;

the first fixing bracket frame and the second fixing bracket frame are arranged in parallel;

the adjustable connection frame is mounted at an end of the first fixing bracket frame and an end of the second fixing bracket frame opposite to the end of the first fixing bracket frame, respectively;

the T-shaped bracket frame is inserted into an end of the adjustable connection frame;

the adjustable connection frame is provided with two fastening bolts;

the fastening bolts cooperate with the first fixing bracket frame, the second fixing bracket frame and the T-shaped bracket frame;

each side of the adjustable connection frame is provided with a longitudinal telescopic bracket;

an auxiliary fastening bolt is arranged below the longitudinal telescopic bracket;

an end of the longitudinal telescopic bracket is provided with a holding locking assembly; and the holding locking assembly includes a mounting case and a block.

6. A lifter, comprising:

a first support base, a second elevating stand assembly, a hand-driven elevating mechanism, a turning-drive mechanism, and a bracket mechanism;

wherein, a lower portion of the second elevating stand assembly is provided with the first support base;

the hand-driven elevating mechanism is arranged on one side of the second elevating stand assembly;

the hand-driven elevating mechanism is internally provided with a drive gear;

a third elevating stand is mounted inside the second elevating stand assembly;

a side wall of the third elevating stand is provided with a rack;

the rack cooperates with the drive gear;

the hand-driven elevating mechanism drives the third elevating stand to move through driving the gear;

the third elevating stand is provided with a fourth elevating stand;

a side wall of the third elevating stand is provided with a drive roller;

the drive roller cooperates with the fourth elevating stand through a second traction rope;

one end of the second traction rope is fixed on a positioning block, and the other end of the second traction rope is fixed on a bottom portion of the fourth elevating stand;

the turning-drive mechanism is provided with a second support base;

the second support base is mounted on the top of the second elevating stand;

one end of the second support base is hinged to a movable support frame, and the other end of the second support base is provided with a locking assembly; and the turning-drive mechanism is provided with the bracket mechanism.

7. The lifter of claim 6, wherein, the second elevating stand assembly is further provided with a second fixing mounting frame and a second armrest;

the second armrest is mounted on one side of the second fixing mounting frame;

the second fixing mounting frame is internally provided with the third elevating stand;

one side of the second fixing mounting frame is provided with a positioning block;

the other side of the second fixing mounting frame is provided with a lock assembly;

the lock assembly cooperates with the rack; and a position-limiting locking ring is arranged below the lock assembly.

8. The lifter of claim 6, wherein, the turning-drive mechanism further comprises a bracket fixing frame, a handle, and a position-limiting post;

a locking flange is arranged at an end of the movable support frame;

a first positioning hole is provided within the locking flange;

the locking assembly cooperates with the first positioning hole;

a trigger rod is arranged below the locking assembly;

the trigger rod controls the locking assembly to expand and contract in a horizontal direction;

the handle is fixed on a side wall of the movable support frame;

an end of the handle is provided with an anti-slide sleeve;

the bracket fixing frame is arranged above the movable support frame; and the bracket mechanism is mounted on the bracket fixing frame.

9. The lifter of claim 6, wherein, the bracket mechanism comprises a first fixing bracket frame, a second fixing bracket frame, a T-shaped bracket frame, and an adjustable connection frame;

the first fixing bracket frame and the second fixing bracket frame are arranged in parallel;

the adjustable connection frame is mounted at an end of the first fixing bracket frame and an end of the second fixing bracket frame opposite to the end of the first fixing bracket frame, respectively;

the T-shaped bracket frame is inserted into an end of the adjustable connection frame;

the adjustable connection frame is provided with two fastening bolts;

the fastening bolts cooperate with the first fixing bracket frame, the second fixing bracket frame and the T-shaped bracket frame;

each side of the adjustable connection frame is provided with a longitudinal telescopic bracket;

an auxiliary fastening bolt is arranged below the longitudinal telescopic bracket;

an end of the longitudinal telescopic bracket is provided with a holding locking assembly; and the holding locking assembly includes a mounting case and a block.

* * * * *